US008870450B2

(12) United States Patent
Mertenat et al.

(10) Patent No.: US 8,870,450 B2
(45) Date of Patent: Oct. 28, 2014

(54) TIMEPIECE ASSEMBLY WHEREIN A BOTTOM PLATE IS CENTRED AND SECURED RELATIVE TO A MIDDLE PART

(71) Applicant: ETA SA Manufacture Horlogère Suisse, Grenchen (CH)

(72) Inventors: Olivier Mertenat, Solothurn (CH); Baptist Wyssbrod, Nidau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 120 days.

(21) Appl. No.: 13/671,872

(22) Filed: Nov. 8, 2012

(65) Prior Publication Data

US 2013/0128707 A1 May 23, 2013

(30) Foreign Application Priority Data

Nov. 17, 2011 (EP) ..... 11189467

(51) Int. Cl.

| | |
|---|---|
| ***G04B 37/04*** | (2006.01) |
| ***G04B 37/05*** | (2006.01) |
| ***G04F 7/06*** | (2006.01) |
| ***G04B 29/02*** | (2006.01) |

(52) U.S. Cl.

CPC ..... *G04B 37/05* (2013.01); *G04F 7/067* (2013.01); *G04B 29/02* (2013.01)

USPC ..... 368/297; 368/300; 368/309

(58) Field of Classification Search

CPC ..... G04B 37/05; G04B 29/02; G04F 7/06

USPC ..... 368/297, 299, 300, 309, 318

See application file for complete search history.

(56) References Cited

U.S. PATENT DOCUMENTS 783,611 A * 2/1905 Chevillat ..... 368/300
865,656 A 9/1907 Porter (Continued)

FOREIGN PATENT DOCUMENTS

CH 160 803 A 3/1933
CH 229 232 A 10/1943

(Continued)

OTHER PUBLICATIONS

English translation of DE1703377.*

(Continued)

*Primary Examiner* — Amy Cohen Johnson
*Assistant Examiner* — Matthew Powell
(74) *Attorney, Agent, or Firm* — Sughrue Mion, PLLC

(57) ABSTRACT

Timepiece assembly (1) comprising a middle part (4) cooperating in abutment with a bottom plate (2) and a screw (6) for securing (5) this bottom plate (2) to this middle part (4), cooperating with an axis (D0) housing (7) of this plate (2), to press a flange (10) onto a first shoulder (8) of this plate (2) in proximity and on a second shoulder (9) of this middle part (4), and this first shoulder (8) is conical or spherical and/or this second shoulder (9) which is conical or spherical, cooperates with this flange (10) on at least two surfaces or points, in an assembled position wherein this plate (2) and this middle part (4) are assembled to each other and in the position wherein this screw (6) is completely screwed into this housing (7).

23 Claims, 11 Drawing Sheets

(56) References Cited

U.S. PATENT DOCUMENTS

| | | | | |
|---|---|---|---|---|
| 2,364,440 | A | 12/1944 | Hasselman et al. | |
| 4,281,406 | A * | 7/1981 | Tanaka | 368/82 |
| 4,391,533 | A * | 7/1983 | Waki | 368/281 |
| 4,831,607 | A * | 5/1989 | Muller | 368/309 |
| 5,430,694 | A * | 7/1995 | Perrot | 368/88 |
| 6,406,178 | B1 * | 6/2002 | Luscher et al. | 368/286 |
| 2008/0101165 | A1 * | 5/2008 | Cretin et al. | 368/297 |

FOREIGN PATENT DOCUMENTS

| | | | |
|---|---|---|---|
| CH | 229 462 | A | 10/1943 |
| CH | 265 254 | A | 11/1949 |
| CH | 282 451 | A | 4/1952 |
| CH | 334 000 | A | 11/1958 |
| CH | 482 238 | A | 7/1969 |
| CH | 619 345 | A | 9/1980 |
| DE | 1 703 377 | U | 7/1955 |
| EP | 1 970 779 | A1 | 9/2008 |
| EP | 2 275 882 | A1 | 1/2011 |
| GB | 2 022 877 | A | 12/1979 |

OTHER PUBLICATIONS

European Search Report of EP 11 18 9467 dated Jul. 26, 2012.

* cited by examiner

D0
RP
RV 19
2
10
6
4
19

P2A
6
P2B
2
10
P4A
4
P4B

24

8
10
6
9
24
2
41
23
4
5
9
10
6
8

E-E

G-G

TIMEPIECE ASSEMBLY WHEREIN A BOTTOM PLATE IS CENTRED AND SECURED RELATIVE TO A MIDDLE PART

This application claims priority from European Patent Application No. 11189467.1 filed Nov. 17, 2011, the entire disclosure of which is incorporated herein by reference.

FIELD OF THE INVENTION

The invention concerns a timepiece assembly including at least one bottom plate, a middle part arranged to cooperate in abutment with said bottom plate, a means of securing said at least one bottom plate to said middle part, said securing means including at least one screw arranged to cooperate in a screwed-in position with at least one axis housing comprised in said bottom plate, to indirectly immobilise said middle part relative to said bottom plate via a flange, each said flange being arranged to transmit the tightening force from said screw by abutting both on a first shoulder comprised in said bottom plate in proximity to each said housing, and on a second shoulder comprised in said middle part in proximity to each said housing.

The invention also concerns a timepiece or piece of jewellery including at least one such timepiece assembly.

The invention concerns the fields of horology, jewellery and more particularly the field of timepieces worn by the user, wristwatches, fob or pendant watches.

BACKGROUND OF THE INVENTION

A timepiece movement is generally secured by the cooperation between a bottom plate of the movement and a middle part or casing ring of the timepiece case, via two or three flanges, depending upon the size of the movement. These flanges are flat or folded and a securing screw holds each flange by friction. This securing method is not perfect, firstly because it does not provide any centring, particularly angular centring, and also because it is very sensitive to shocks and accelerations, which may cause some movements to move angularly, until they become detached from their case in the event of a shock, and are then only secured by the stem, which results in misaligned components and wear. Simply tightening the securing screws is sufficient to angularly move the movement.

The defects caused in this manner are unacceptable in many timepieces, and more specifically in those which have additional functions controlled by push-buttons, such as chronographs. The push force transmitted to the push-buttons by the user is often significant, and if the geometry is wrong, the push-buttons and associated mechanisms are subjected to additional stresses and thus high wear. This is particularly the case for a single chronograph button which is sensitive to this type of geometrical defect.

Keeping the movement and case firmly secured is a gauge of longevity and the problem is therefore serious. Curiously, few solutions have been provided to this problem. Most are based on holding the movement resiliently in the case, as in CH Patent No. 482 238 in the name of Claude Baillod, which has an elastic annular element at the periphery of the case, or in EP Patent No. 1 970 779, in the name of Richemont, where a gasket centres the movement when it is compressed while being fitted into the case, or EP Patent Application No. 2, 275 882, in the name of ETA SA which has an annular part pushing a casing ring onto the middle part. Precise centring solutions have been proposed, particularly by CH Patent No. 160 803 in the name of Aegler Rolex, with a cam used for centring, but with plane-plane friction which is therefore liable to be displaced in the event of a shock. CH Patent No 229 462 in the name of Henri Collomb and Tavannes Watch proposed a centring and holding method using a ring spring which rests on the inner wall of the case, working in friction. CH Patent No. 229 232 by the same Applicants discloses holding the movement via a spring. CH Patent No. 265 254 in the name of Henri Collomb proposes centring the movement by a force fitted flange. These different designs have not properly resolved the problem of resistance to shocks during use and the problem remains to this day. DE Patent No. 17 03 377 U in the name of JUNGHANS discloses a flange abutment between a bottom plate and a washer which itself rests on the middle part. The corresponding bearing surfaces are flat which in unfavourable for proper centring.

CH Patent Application No. 619 345 in the name of PERRET FRERES discloses a peripheral gasket, with a C-shaped section, between a superposed back cover and middle part, and a casing ring carrying a movement and comprising lugs which project radially through apertures arranged in the peripheral gasket.

GB Patent Application No. 2 022 877 A in the name of SUWA SEIKOSHA discloses a flange holding a movement relative to a middle part wherein the flange is in an oblique wedged position.

U.S. patent application Ser. No. 865 656 A in the name of PORTER WILSON discloses a configuration with a flange spring and alternating supports on the flange and middle part.

SUMMARY OF THE INVENTION

It is an object of the invention to overcome the problems and limitations of the prior art by proposing a reliable solution for centring a bottom plate in relation to a middle part, and ensuring that this centring is maintained over time, in particular in the event of shocks.

The invention therefore concerns a timepiece assembly including at least one bottom plate, a middle part arranged to cooperate in abutment with said plate, and a means of securing said at least one bottom plate to said middle part. Said securing means includes at least one screw arranged to cooperate in the screwed-in position with at least one axis housing comprised in said bottom plate, to indirectly immobilise said middle part relative to said bottom plate via a flange, each said flange being arranged to transmit the tightening force of said screw by abutting both on a first, conical or spherical shoulder comprised in said bottom plate in proximity to each said housing, and on a second, conical or spherical shoulder comprised in said middle part in proximity to each said housing. Said assembly is characterized wherein, in an assembled position wherein said bottom plate and said middle part are assembled to each other and when said screw is completely screwed into said housing, said first shoulder and/or said second shoulder cooperate with said flange on at most two surfaces or points According to a feature of the invention, said flange is independent of said screw and includes a top bearing surface arranged to cooperate, in said assembled position and when said screw is completely screwed into said housing, with a bottom bearing surface comprised in said screw, on a contact surface of revolution relative to said axis of said housing.

According to a feature of the invention, said middle part includes stop means arranged to cooperate with complementary stop means comprised in said bottom plate to limit the space between said middle part and said plate, in said assembled position and when said screw is completely screwed into said housing.

According to a feature of the invention, any normal line, at a point on said first shoulder of said bottom plate, to the tangent plane at this point to said shoulder, passes through a parallel axis at a distance from said axis of said housing, at a point which is located outside said housing on the side of said housing through which said screw is inserted into said housing.

According to another feature of the invention, said first shoulder of said bottom plate is of revolution about said axis.

According to a feature of the invention, said second shoulder of said middle part is of revolution about an axis which is parallel to said axis of said housing in said assembled position, and any normal line, at one point on said second shoulder of said middle part, to the tangent plane at that point to said shoulder passes through said axis, at a point which is located, in said assembled position of said bottom plate and said middle part, outside said housing on the side of said housing through which said screw is inserted into said housing.

According to a feature of the invention, in said assembled position and when the screw is completely screwed into said housing, said axis of said second shoulder of said middle part is at a distance from said axis of said first shoulder of said bottom plate, and said axis and said axis are parallel on either side of said axis of said housing.

According to a feature of the invention, said flange has a bearing surface arranged to cooperate with said first shoulder of said bottom plate, and with a second shoulder of said middle part, which is of revolution about an axis perpendicular to said top bearing surface and arranged to coincide with said axis of said housing, in said assembled position and position where said screw is completely screwed into said housing.

According to a feature of the invention, said flange has a bearing surface arranged to cooperate with said first shoulder of said bottom plate, and with a second shoulder of said middle part, said bearing surface being of revolution about a flange axis perpendicular to said top bearing surface and arranged to coincide with said axis of said housing, in said assembled position and position where said screw is completely screwed into said housing.

According to a feature of the invention, said bearing surface is reduced to a circular edge of revolution about said flange axis.

According to a feature of the invention, connected to said bearing surface and on the opposite side to said top bearing surface, said flange includes a tapered surface arranged to allow said flange axis of said flange limited angular mobility relative to said axis of said housing of said screw, in the assembled position and while said screw is being screwed into said housing.

According to a feature of the invention, said tapered surface is conical at an angle of taper of the flange relative to a perpendicular plane to said flange axis, said first shoulder of said bottom plate is conical at an angle of taper relative to a perpendicular plane to said axis, said second shoulder of said middle part is conical at an angle of taper relative to a perpendicular plane to said axis and said flange angle of taper is smaller, by a value of less than 2°, than said angles of taper.

According to a feature of the invention, said contact surface of said flange is formed by a cruciform or triangular star-shaped projecting bearing relief, and the contact between said contact surface of said flange and said first shoulder occurs at one point or two points, the contact between said bearing surface of said flange and said second shoulder occurs at one point or two points and, when the contact between said flange and said first shoulder and said second shoulder occurs at four points when the screw is in the completely screwed in position in said housing, the diagonals of the quadrilateral formed by said four points intersect in proximity to said axis of said housing, and, when the contact between said flange and said first shoulder and said second shoulder occurs at three points when said screw is in the completely screwed in position in said housing, the barycentre of the triangle formed by said three points is located in proximity to said axis of said housing.

According to a feature of the invention, said bottom plate forms a support for at least one timepiece movement, and said middle part is arranged to at least partially contain said movement.

The invention further concerns a timepiece or piece of jewellery comprising at least one such timepiece assembly, or a timepiece assembly wherein said bottom plate forms a support for at least one component of a piece of jewellery, and wherein said middle part is arranged to at least partially contain said component.

BRIEF DESCRIPTION OF THE DRAWINGS

Other features and advantages of the invention will appear upon reading the following detailed description, with reference to the annexed drawings, in which:

FIG. 2A is a detail of FIG. 2.

FIGS. 21 to 30 illustrate various variants which can be combined with each other.

FIG. 32 shows a plan view of the middle part and FIG. 33 shows a cross-section of a detail of a female semi-cone in said middle part. FIG. 34 illustrates a plan view of the plate, FIG. 35 a detail of the arrangement with a female semi-cone, shown in cross-section in FIG. 36 in addition to a thread for receiving a flange screw. Said flange is shown in plan in FIG. 37 and in cross-section in FIG. 38.

DETAILED DESCRIPTION OF PREFERRED EMBODIMENTS

Figure 1A:
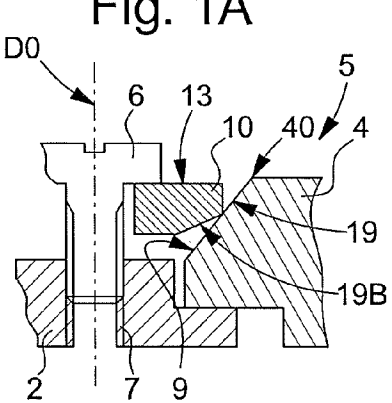
FIGS. 1A and 1B show details of two variants of FIG. 1, FIG. 1A with a simpler middle part, and FIG. 1B with plays arranged between the bottom plate and middle part to make assembly easier.

The invention concerns the fields of horology, jewellery and more particularly the field of timepieces worn by the user, wristwatches, fob or pendant watches.

The invention proposes a reliable solution for guaranteeing the centring of a plate relative to a middle part and ensuring that the centring lasts over time and with use, in particular in the event of shocks. The invention is described here in the more particularly illustrated application to a timepiece plate incorporated in a middle part, with a means of securing using screws cooperating with a housing in the plate. This description is not at all limiting, and the invention is applicable to any combination of two components which have to be both well positioned and securely held in relation to each other. Those skilled in the art will have no difficulty in transposing the present description to the case wherein a covering part, here called the middle part, comprises a housing cooperating with the securing means. Likewise, the application to a piece of jewellery comprising two structure components is easy, since the invention is specifically devised for the reduced dimensions of a timepiece and to resist the high stresses, particularly in terms of acceleration, that a timepiece has to withstand. The security and durability of the assembly also provide considerable security for the assembly of a part comprising jewellery elements.

The invention thus concerns a timepiece assembly 1. This assembly 1 includes at least one plate 1, a middle part 3 arranged to cooperate in abutment with plate 2, and a means of securing the at least one plate 2 to middle part 4.

The term "middle part" should not be interpreted in a limiting manner, as the component designated in this manner may be, in particular, a casing ring, or similar.

This securing means 5 includes at least one screw 6 arranged to cooperate in the screwed-in position with at least one housing 7 of axis D0 comprised in plate 2, to indirectly immobilise middle part 4 relative to plate 2 via a flange 10. Each said flange 10 is arranged to transmit the tightening force of a screw 6 by abutting both on a first shoulder 8, comprised in plate 2 in proximity to each housing 7, and on a second shoulder 9, comprised in middle part 4 in proximity to each housing 7.

Preferably, first shoulder 8 is conical or spherical, and second shoulder 9 is conical or spherical, the axes of revolution of these cones or spherical sectors (as appropriate) being close, parallel to each other and substantially parallel or parallel to axis D0.

According to the invention, the first shoulder 8 and/or second shoulder 9 cooperate with flange 10, on at least one point and at most two surfaces or points, in said assembled position wherein plate 2 and middle part 4 are assembled to each other and in the position where screw 6 is completely screwed into housing 7. "Surface" means here a connecting contact surface, which may consist of a surface area, or a line or a point.

In a particular embodiment, plate 2 and middle part 4 are only in contact with flange 10 at points. Preferably, in the assembled position where plate 2 and middle part 4 are assembled to each other and in the position where screw 6 is completely screwed into housing 7, plate 2 and middle part 4 each cooperate with flange 10 on at least two points.

The geometry of first shoulder 8, second shoulder 9 and screw 6, which cooperates with said two shoulders, is researched so that flange 10 is strictly perpendicular to axis D0 of housing 7 in the assembled position where screw 6 is completely screwed in.

Screw 6 is only subject to normal stress.

Figure 1:
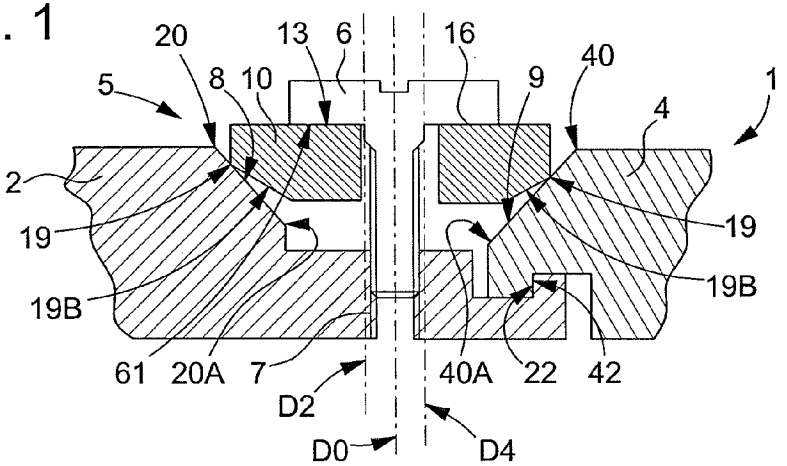
FIG. 1 shows a schematic, partial cross-section, passing through the axis of a screw for holding and securing a flange on a bottom plate and a middle part of a timepiece assembly according to the invention, in a preferred embodiment wherein said flange includes a bearing surface of revolution reduced to a circular edge, which abuts on a conical shoulder comprised in said plate, and on a conical shoulder comprised in said middle part, said assembly being shown in the assembled position and where the screw is screwed into its housing.
Figures 4, 5:
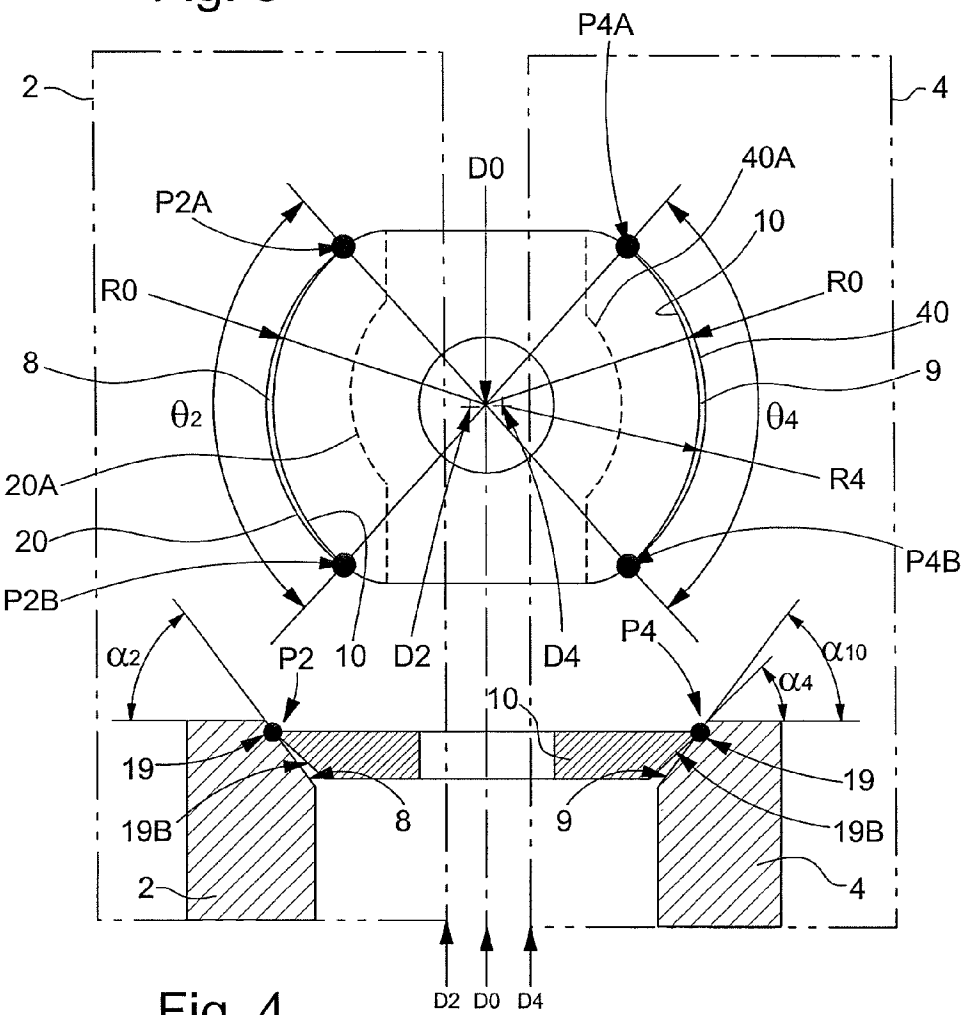
FIG. 4 shows a detail of FIG. 1, at the abutment between the flange and the conical shoulders.
FIG. 5 shows a schematic, partial, top view simply of the flange abutting on the conical shoulders.

In a preferred embodiment, as seen in particular in FIGS. 1 and 5, the first shoulder 8 cooperates with flange 10 on at least one point and at most two points, and second shoulder 9 cooperates with flange 10 on at least one point and at most two points.

FIGS. 1, 2, 3, 4, 5, 12, 13, 14 and 17 illustrate preferred embodiments where first shoulder 8 cooperates with flange 10 at two points, and second shoulder 9 cooperates with flange 10 at two points, i.e. four points in total.

FIGS. 6 to 9 illustrate variants where the hold is on one side at only one point, and the other side at two points, i.e. a total of three points. These variants with three points are preferably combined with a means of maintaining angular indexing, or the securing areas are distributed around the timepiece movement, for example in a triangle, in such a way that the angular position is ensured by the actual distribution of said areas on the timepiece.

Figure 10:
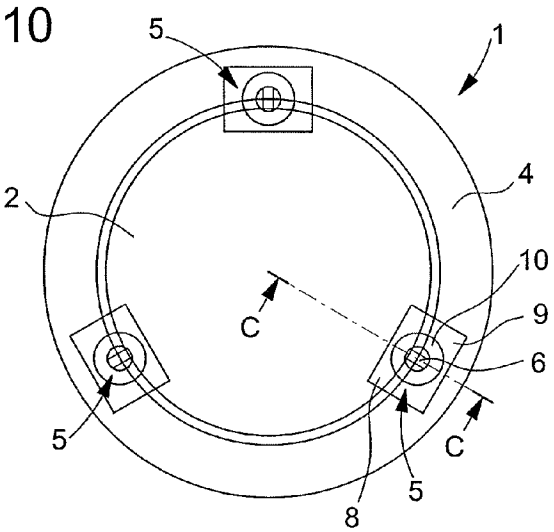
FIG. 10 shows a schematic, partial, top view of an assembly according to the invention, wherein the plate is held centred in the middle part by three sets of inclined planes, with, in each case, one on the plate and one on the middle part, and on each of which a similar flange to that of FIG. 1 is engaged in abutment.
Figure 11:
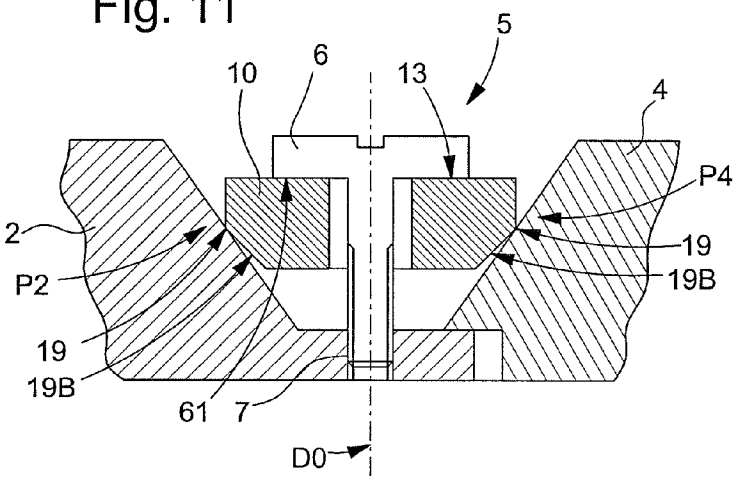
FIG. 11 is a partial cross-section of FIG. 10 in a plane CC passing through the axis of one of the screws.

FIGS. 10 and 11 illustrate a variant wherein first shoulder 8 cooperates with flange 10 at one point, and second shoulder 9 cooperates with flange 10 at one point, i.e. two points in total. As for the variants with three points, this variant requires particular indexing means, or, as illustrated here, a peripheral repetition of securing means 5, so as to ensure positioning and centring, achieved by triangulation here.

Figure 15:
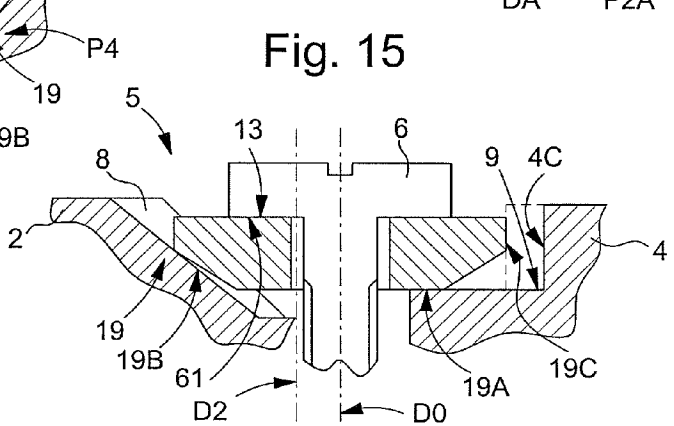
FIG. 15 shows, in a similar manner to FIG. 1, a variant wherein the plate includes a conical shoulder, and wherein the middle part includes a flat portion which receives a bottom surface of the flange in abutment.
Figure 16:
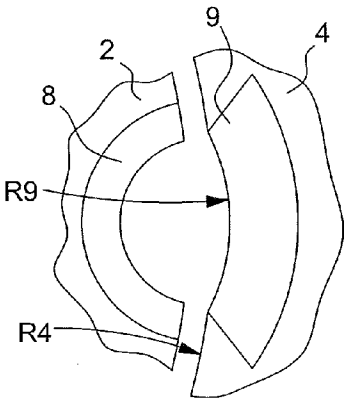
FIG. 16 shows a schematic, partial, top view of the shoulders of FIG. 15.

The variant of FIGS. 15 and 16 illustrates the case of abutment only on the plate at two points, while abutment on the middle part occurs in a conventional manner on a flat portion. This variant requires particular indexing means, or a peripheral repetition of securing means 5, so as to ensure positioning and centring, particularly by triangulation.

The preferred variant is that where flange 10 cooperates with first shoulder 8 and second shoulder 9 at two times two points, i.e. four points in total. A degree of pivoting freedom of the plate relative to the middle part must be subtracted from these four points. The system is not hyperstatic and is self-sufficient: a single arrangement equipped in this manner is sufficient to ensure precise centring and good durability in use. The abutment of flange 10 on sloped surfaces prevents any slipping and ensures shock resistance.

The use of screw 6 constitutes an economical and reliable embodiment of securing means 5. The centring and securing operations are only accomplished when screw 6 is in the screwed-in position. Screwing screw 6 into housing 7 guarantees the auto-centring of flange 10 relative to first shoulder 8 and second shoulder 9, which flange 10 has a tendency to move apart from each other when the screw is being tightened. Of course, other means can exert an axial force pushing flange 10 towards housing 7 and tending to straighten it, via compression or traction force. For example, an irreversible means of assembly such as placing a rivet through flange 10 and housing 7 may constitute an efficient alternative for an inexpensive product. It is thus clear that the use of screw 6 constitutes a preferred but non-limiting embodiment. The following description is limited, for the sake of simplification, to the use of a screw as the vector transmitting axial force to flange 10 in a driving in movement.

Preferably, according to the invention, flange 10 is independent of screw 6 and has a top bearing surface 13, which is arranged to cooperate, in the assembled position and the position where screw 6 is completely screwed into housing 7, with a bottom bearing surface 61 comprised in screw 6. The contact between the top bearing surface 13 of the flange and the bottom surface 61 of screw 6 occurs on a contact surface 16, which is preferably a surface of revolution relative to the axis D0 of housing 7, or occurs on the points or surfaces distributed over said surface of revolution.

The auto-centring system enables flange 10 to have a position in which its top surface 13 is perpendicular to axis D0 of housing 7, preferably corresponding to a thread of plate 2. This prevents any perturbation torque which would be exerted in the event of differential abutment on only one of the lateral surfaces formed by shoulders 8 and 9.

Figure 2:
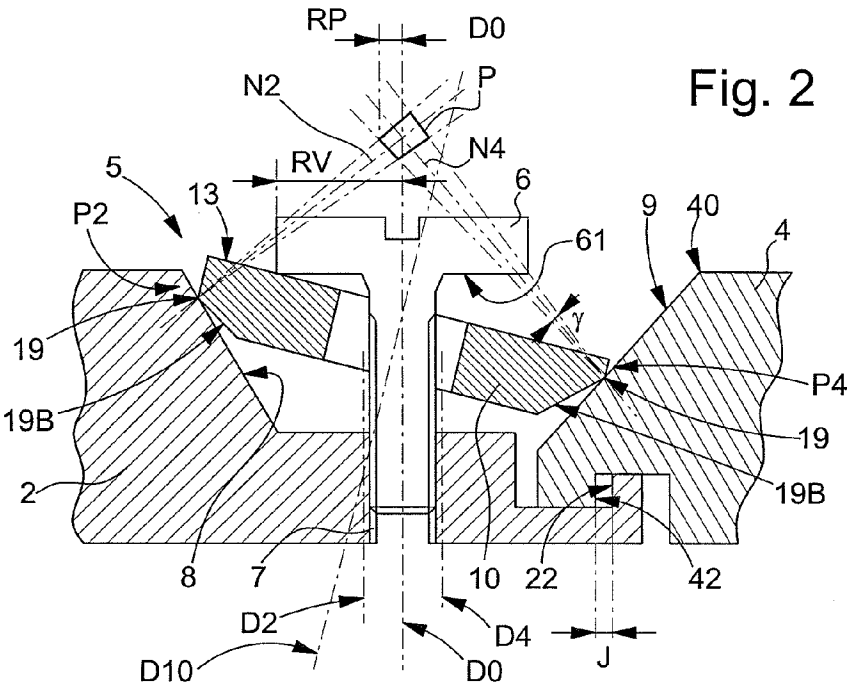
FIG. 2 shows the assembly of FIG. 1 in an intermediate position while the screw is being tightened, wherein the screw abuts on the flange and pushes it onto the conical shoulders.
Figures 2A, 21, 22A, 22B, 22C, 24, 25, 27, 28, 29, 30:
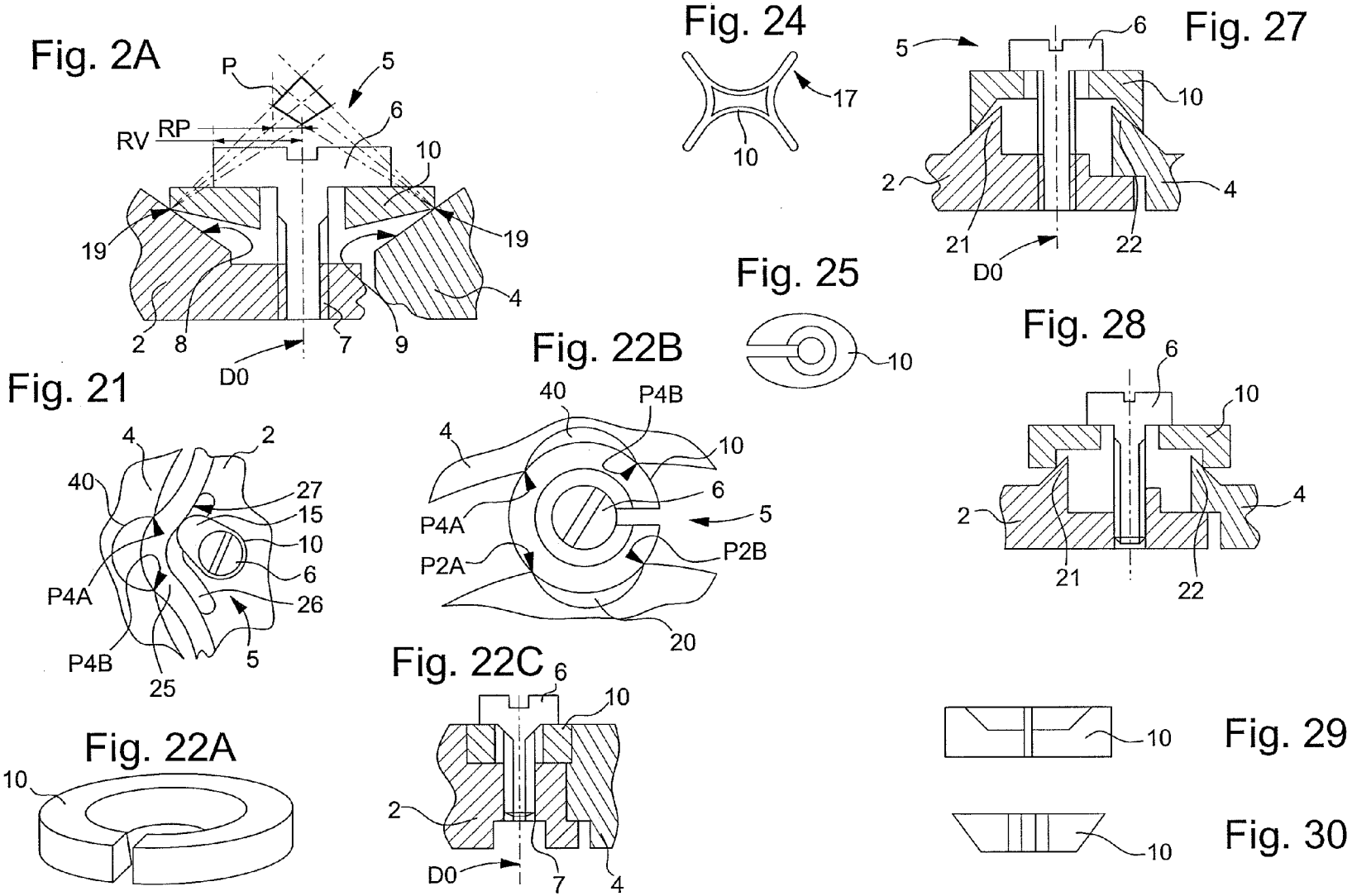

To achieve the auto-centring function, the radius RV, relative to axis D0, with which bottom surface 61 of the head of screw 6 rests on top surface 13 of flange 10 must be greater than the maximum radius RP, relative to said axis D0, of the maximum polygon P defined by the envelope of possible reaction forces of shoulders 8 and 9, as seen in FIGS. 2 and 2A. This maximum polygon P results from a slight angular clearance y preferably set for flange 10 relative to shoulders 8 and 9, by the design of said shoulders. This clearance depends on the friction material torque between flange 10 and shoulders 8 and 9. In the example embodiment illustrated by the Figures and corresponding to the numerical values cited by way of non-limiting example in the present description, the friction coefficient is on the order of k=0.15.

Figure 8:
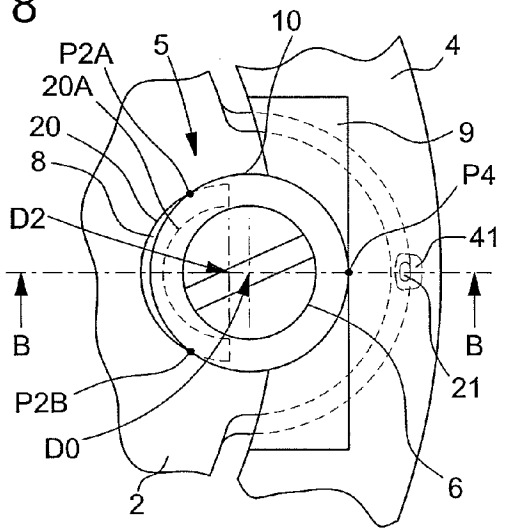
FIG. 8 shows a schematic, partial, top view of a variant of the invention wherein an identical flange to that of FIG. 1 rests on a conical plane on the plate side and on an inclined plane on the middle part side.
Figure 9:
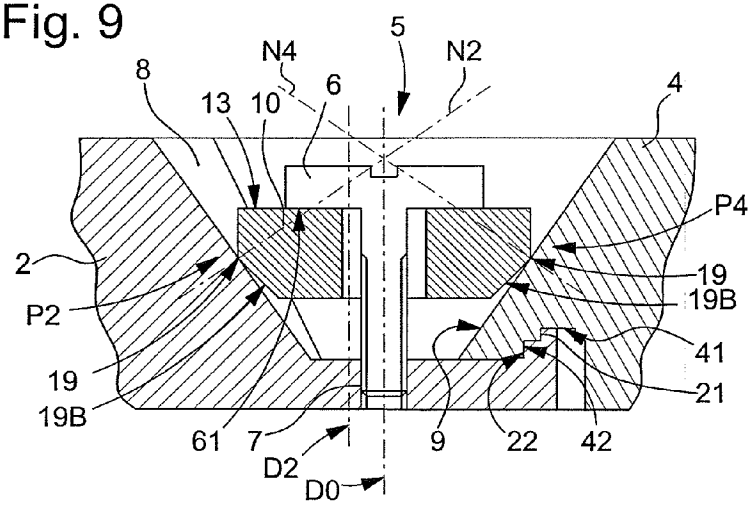
FIG. 9 is a cross-section of FIG. 8 in a plane BB passing through the axis of the screw.

FIG. 8 illustrates an embodiment of the invention including a middle part 4 with a very simple profile.

Figure 1B:
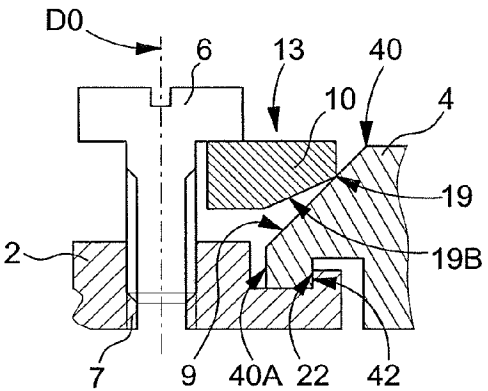

In an embodiment seen in FIGS. 1, 2, 3, 7 and 9, middle part 4 includes a stop means 42, which is arranged to cooperate with complementary stop means 22 comprised in plate 2, to limit the distance between middle part 4 and plate 2, in the assembled position and the position where screw 6 is completely screwed into housing 7. Stop means 42 and complementary stop means 22 may be formed by bearing surfaces, grooves and shoulders, or suchlike. FIG. 1B shows a variant with plays arranged between plate 2 and middle part 4 at stop means 42 and complementary stop means 22, for making assembly easier. Preferably, the complementary stop means are provided by the fitting.

Figure 19:
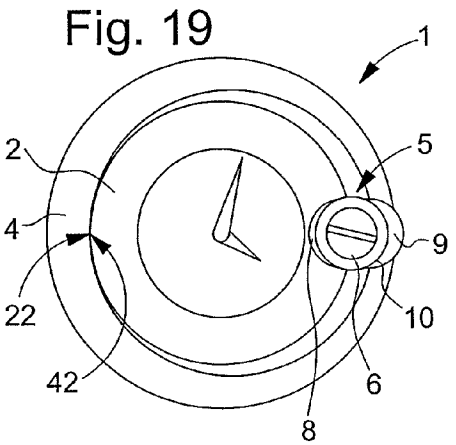
FIG. 19 shows a schematic, top view of an assembly according to the invention wherein the stop preventing spacing between the plate and middle part is formed by the edges of said plate and middle part, diametrically opposite the edges carrying the conical shoulders on which the centring flange rests.

FIG. 19, which shows an assembly where the stop preventing separation between plate 2 and middle part 4 is formed by the edges thereof, diametrically opposite the edges bearing conical shoulders on which the centring flange 10 rests, also illustrates the use of a diametrically opposite end of the plate and the middle part to fulfill this function.

It is clear that the application of a driving in force on flange 10 tends to separate first shoulder 8 of the plate and second shoulder 9 of the middle part by moving them apart. The invention implements a particular geometry of these shoulders which tends to straighten flange 10, i.e. to make its top surface 13 perpendicular to the direction of insertion of screw 6, which is axis D0 of housing 7 here. The bottom surface 61 of screw 6 exerts stress on this top surface 13, which is a torque that must tend to be balanced out when the screw is tightened. By limiting the contact between flange 10 and the shoulders to isolated contact points, the reaction of shoulders 8 and 9 to the stresses applied by flange 10 is perpendicular to the tangent plane to the shoulder at each point of abutment concerned.

Mounting flange 10 freely on screw 6, as seen in the Figures, then allows flange 10 to be automatically centred, and the top surface 13 thereof to be returned perpendicular to axis D0, when screw 6 is tightened.

Thus, preferably, in order to make these shoulders, any normal line N2 at a point on first shoulder 8 of plate 2, to the tangent plane at this point to said shoulder, passes through an axis D2 parallel to and at a distance from axis D0 of housing 7, at a point which is located outside housing 7 on the side of housing 7 through which screw 6 is inserted into housing 7, It is the non-zero distance between axis D0 of housing 7 and axis D2, when the centre of the radius of flange 10 is different from the centre of the thread which forms housing 7, in a preferred embodiment visible in FIGS. 1, 2, 3 and 7 amongst others, which means that a contact reduced to two contact points can be obtained between flange 10 and first shoulder 8, as will be seen in more detail in FIG. 5. This eccentricity is preferably comprised between 0.10 and 0.20 mm.

Preferably, first shoulder 8 of plate 2 is a surface of revolution about said axis D2.

Likewise, the second shoulder 9 of middle part 4 is a surface of revolution about an axis D4 which is parallel to axis D0 of housing 7 in the assembled position. Any normal line N4, at a point on second shoulder 9 of middle part 4, to the tangent plane at this point to said shoulder, passes through said axis D4, at a point which is located, in the assembled position of plate 2 and middle part 4, outside housing 7 on the side of housing 7 through which screw 6 is inserted into housing 7.

Figure 7:
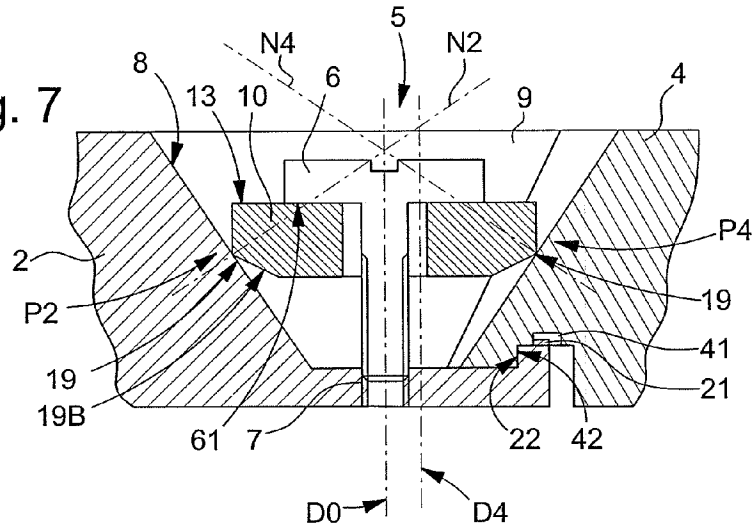
FIG. 7 is a cross-section of FIG. 6 in a plane AA passing through the axis of the screw.

Thus, preferably and as seen in particular in FIGS. 1 and 7, in the assembled position and where screw 6 is completely screwed into housing 7, axis D4 of second shoulder 9 of middle part 4 is at a distance from axis D2 of first shoulder 8 of plate 2, and axis D4 and axis D2 are parallel to each other and located on either side of axis D0 of housing 7.

In the embodiments with less than four contact points, or conversely more than four contact points between flange 10 and the two shoulders 8 and 9, middle part 4 includes a means 41 of angularly indexing position in an angular direction relative to a complementary angular indexing means 21 of plate 2 to which middle part 4 is coaxial in the assembled position. This angular indexing is achieved to define an angularly indexed position of plate 2 relative to middle part 4.

In this indexed position, and when second shoulder 9 is a sloping surface, advantageously any normal, at a point on second shoulder 9 of middle part 4, to the tangent plane at that point to said shoulder, passes through axis D4, at a point which is located, in the assembled position of plate 2 and middle part 4, outside housing 7 on the side of housing 7 through which screw 6 is inserted into housing 7.

Likewise, in the indexed position, and when first shoulder 8 is a sloping surface, advantageously any normal line, at a point on first shoulder 8 of middle part 2, to the tangent plane at that point to said shoulder, passes through axis D2, at a point which is located, in the assembled position of plate 2 and middle part 4, outside housing 7 on the side of housing 7 through which screw 6 is inserted into housing 7.

In the preferred case of FIGS. 1, 2, 4 and 5, the position indexing results from shoulders 8 and 9 which are each conical surfaces, preferably with identical conicity.

Preferably, flange 10 includes a bearing surface 19, arranged to cooperate with a first shoulder 8 of plate 2 and with a second shoulder 9 of middle part 4. This bearing surface 19 is a surface of revolution about a flange axis D10 perpendicular to the top bearing surface 13 and arranged to coincide, in the assembled position and the position where screw 6 is completely screwed into housing 7, with axis D0 of housing 7.

Advantageously, in order to give priority to the isolated contacts on flange 10, flange 10 is a conical flange, and bearing surface 19 is reduced to an edge. In the variant of FIGS. 1, 2, 4 and 5, this edge 19 is always the same, regardless of the position of flange 10, and revolves in a circular motion about flange axis D10.

Figure 3:
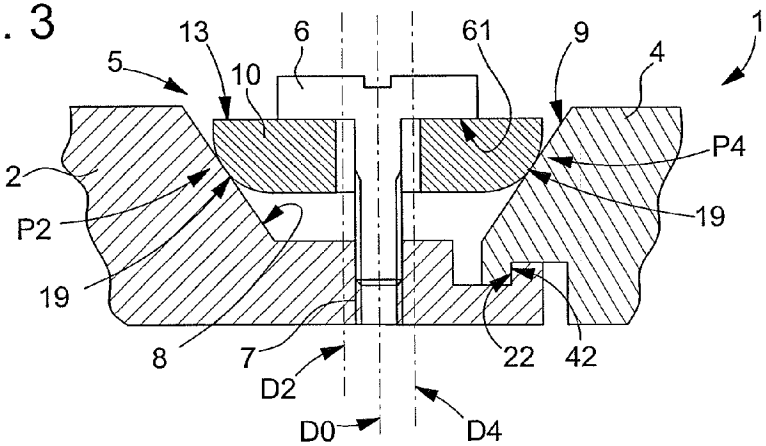
FIG. 3 shows, in a similar manner to FIG. 1, a variant where the bearing surface of the flange is substantially toric.

The configuration of FIG. 3 also corresponds to a contact on an edge, but which is not the same according to the position of the flange relative to shoulders 8 and 9: surface 19 is toric or in a section of a sphere, and shoulders 8 and 9 are conical surfaces.

Advantageously, in order to prevent flange 10 performing motions of too large amplitude, flange 10 includes, connected to bearing surface 19 and on the side opposite top bearing surface 13, a tapered surface 19B, which is arranged to allow the flange axis D10 of flange 10 restricted angular mobility relative to axis D0 of housing 7 of screw 6, in the assembled position and while screw 6 is being screwed into housing 7.

Preferably, this tapered surface 19B is conical at a taper angle of flange $\alpha$10 relative to a plane perpendicular to flange axis D10. The first shoulder 8 of plate 2 is conical at a taper angle $\alpha$2 relative to a plane perpendicular to axis D2. The second shoulder 9 of middle part 4 is conical at a taper angle $\alpha$4 relative to a plane perpendicular to axis D4. The flange taper angle $\alpha$10 is smaller, by a difference in value of less than 2°, and preferably close to 1°, than taper angle $\alpha$2 and than taper angle $\alpha$4. Preferably, these two angles $\alpha$2 and $\alpha$4 are selected to have an equal value. In a preferred embodiment, the flange taper angle $\alpha$10 has a value of 52°, and the taper angle $\alpha$2 and taper angle $\alpha$4 each have a value of 53°. These values determine a value of angle $\gamma$ which guarantees that the maximum radius RP of polygon P remains lower than the abutment radius RV of screw 6 on flange 10 and, therefore, that the auto-centring conditions are always satisfied. In a preferred embodiment, first shoulder 8 of plate 2 is conical at an angle $\alpha$2 relative to a plane perpendicular to axis D2, and second shoulder 9 of middle part 4 is conical at a conical angle $\alpha$4 relative to a perpendicular plane to axis D4 identical to taper angle $\alpha$2. And, in a plane perpendicular to axis D0 of housing 7 of screw 6 and corresponding to the abutment of flange 10 on first shoulder 8 and on second shoulder 9, in the assembled position where screw 6 is completely screwed into housing 7, radius R2 of the section of first shoulder 8 and radius R4 of the section of second shoulder 9 have values comprised between 0.91 and 0.97 times the value of radius R0 of the shoulder of flange 10, on its bearing surface 19, with the first shoulder 8 and second shoulder 9. Preferably, these two values are equal and close to 0.95 times the value of radius R0. The eccentricity values between axis D2 and axis D0 on the one hand, and between axis D4 and axis D0 on the other hand, are comprised between 0.03 and 0.05 times the value of radius R0 of the shoulder of flange 10, and preferably close to 0.038 times the value of radius R0.

Naturally, in particular embodiments, the orders of magnitude of the respective diameters can be reversed, and the eccentricity remains favourable for the stability of the mechanism.

Preferably, the contact between contact surface 19 of flange 10 and the first shoulder 8 occurs at two points P2A, P2A separated by a central angle $\theta$2 relative to axis D0 of housing 7, the contact between bearing surface 19 of flange 10 and second shoulder 19 occurs at two points P4A, P4B separated by a central angle $\theta$4 relative to axis D0 of housing 7 and the value of each of the central angles $\theta$2; $\theta$4 is comprised between 53° and 118°.

These angles $\theta$2; $\theta$4 depend upon the geometry of the assembly, and in particular the elements illustrated in FIG. 5: the relative positions of axes D0, D2 and D4, diameters R2 and R4 of the cones of shoulders 8 and 9 in the plane where flange 10 abuts once screw 6 has been completely tightened, conical angles $\alpha$2 and $\alpha$4 of the cones of plate 2 and middle part 4, radius R0 of flange 10 at the contact points, and also the thickness of flange 10.

As a result of the auto-centring, clearly shown in FIG. 2, flange 10 remains perpendicular to axis D0 of housing 7 when screw 6 is in the tightened position. Flange 10 is only stressed by normal forces, and works in friction. The eccentricity of axes D2 and D4 relative to axis D0 and the difference in diameter between flange 10 and shoulders 8 and 9 allows the movement to be locked via its shape to the case without any play, which resolves the problem raised.

Preferably, first shoulder 8 is a surface of revolution about an axis D2 which is parallel to axis D0 of housing 7 and separated therefrom by a distance of 0.10 to 0.20 mm.

Preferably, second shoulder 9 is a surface of revolution about an axis D4 which is parallel to axis D0 of housing 7 and, in the assembled position, separated therefrom by a distance of 0.10 to 0.20 mm.

The eccentricity of the axes and gradients or slopes of the flange bearing surfaces are calculated such that, even if angle $\theta$2 varies according to the embodiment within the range of tolerance, the two contact areas or points P2A and P2B exist in all cases. Owing to the invention, the play of usual tolerances is absorbed in the components, as is the influence of any excess thickness due to surface treatment, to guarantee the presence of the two contact points in the preferred embodiment of the invention In a particular embodiment example, illustrated in FIGS. 31 to 38, middle part 4 is made of stainless steel or similar, flange 10 of a DIN 1.4197 alloy with a Vickers hardness of around 550, and the plate of CuZn38Pb2 or similar, with a Vickers hardness of close to 120. Flange 10 has a point angle of 76°, which represents an angle $\alpha$4 of 52°, the largest external diameter of the cone is 3.15 mm, and the thickness is 0.35 mm, and it has a bore of 1.30 mm; advantageously this flange 10 has two flat portions, 2.6 mm apart, to save space. Plate 2 has a female cone with a point angle of 74°, which represents an angle $\alpha$2 of 53° between two diameters of 2.2 and 3.0 mm, it is offset by around 0.12 mm, the axis of the thread receiving a horological screw S1 has a Vickers hardness of around 590, the tightening torque of this screw on the conical flange is 4.5 to 5 N×cm. Middle part 4 includes a female cone with the same gradient as plate 2, wherein the theoretical axis position is around 0.22 mm away from the axis of the female cone of plate 2. In practice, the use of the usual horological manufacturing and surface treatment tolerances for this particular embodiment is compatible with the contact comprising two contact points in any configuration, which is an important advantage of the invention.

It will also be noted that there are always stresses on both sides of the thread, which prevents screw 6 from being loosened.

Figure 31:
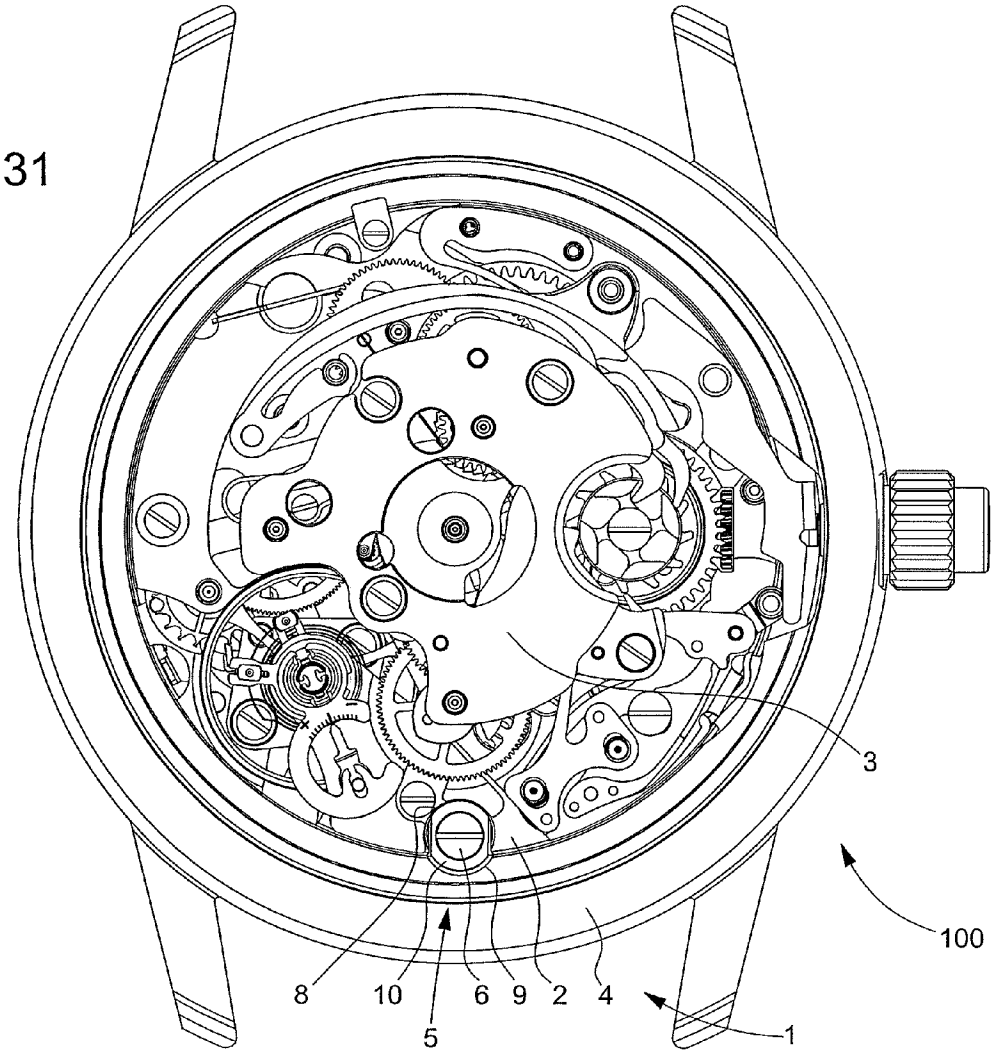
FIGS. 31 to 38 illustrate a preferred embodiment with a single centring and securing arrangement of the invention, disposed at six o'clock on a watch, shown in a plan view in FIG. 31.
Figure 36:
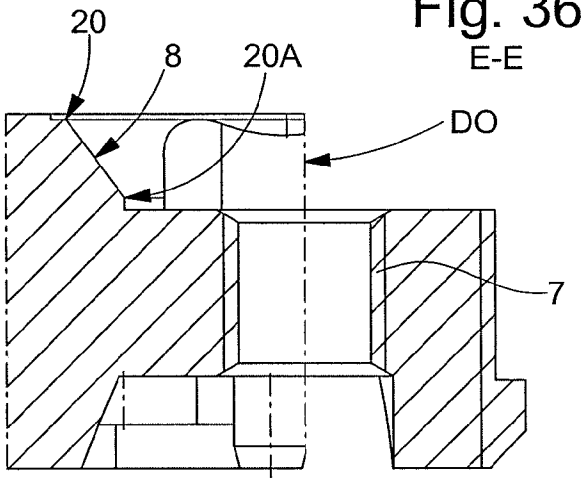
Figure 33:
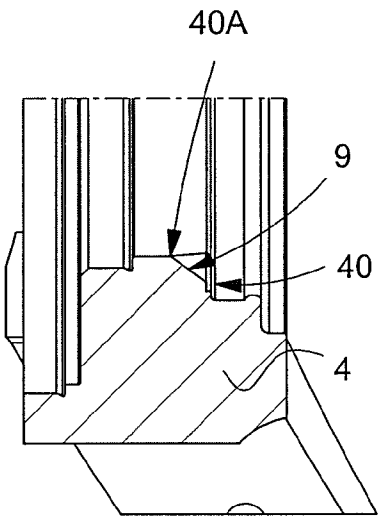
Figure 32:
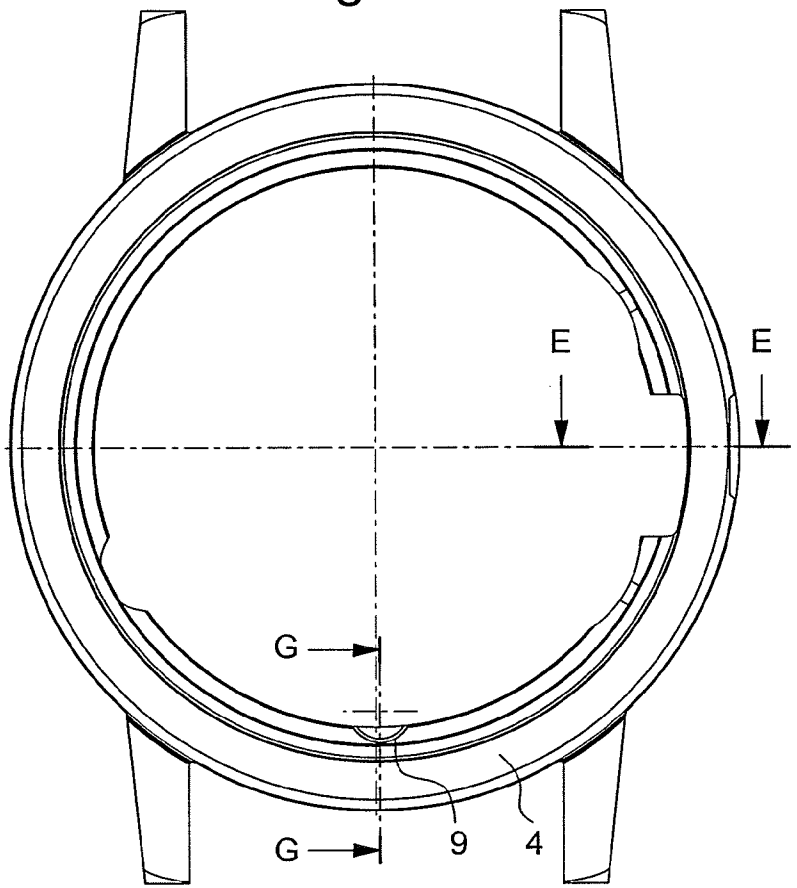
Figure 35:
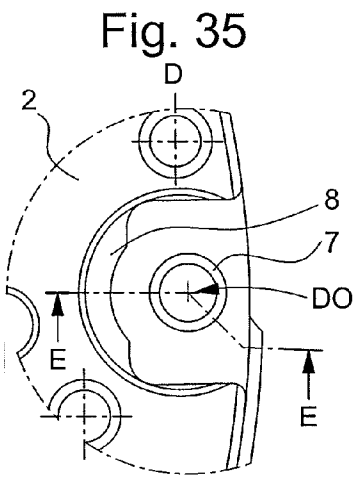
Figure 37:
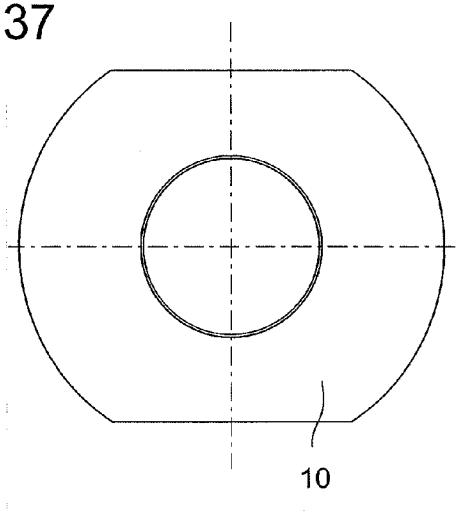
Figure 34:
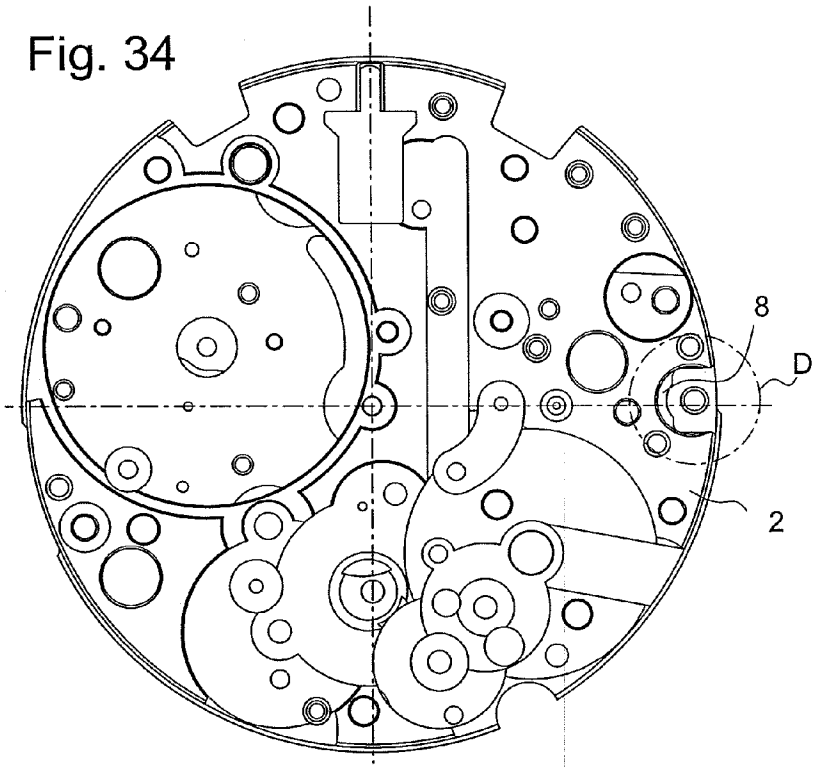
Figure 38:
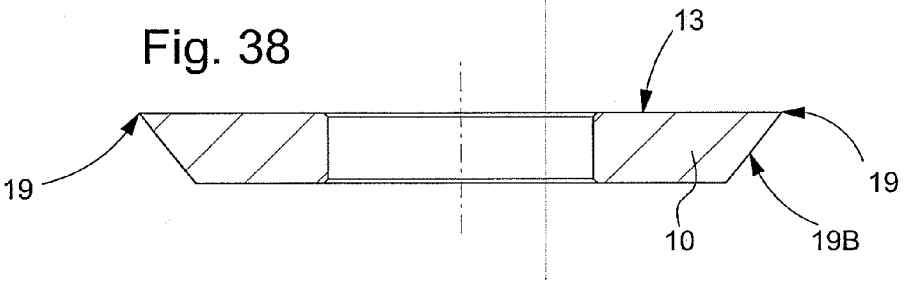

In this embodiment of a chronograph with a single push-button in FIG. 31, the invention prevents micro-angular movements between the movement and the middle part, and it prevents additional friction between the middle part and the push-button and the risk of seizing.

Different variations of the invention are possible according to the profiles used, both for contact surface 19 of flange 10 and for the profiles of shoulders 8 and 9.

Figure 6:
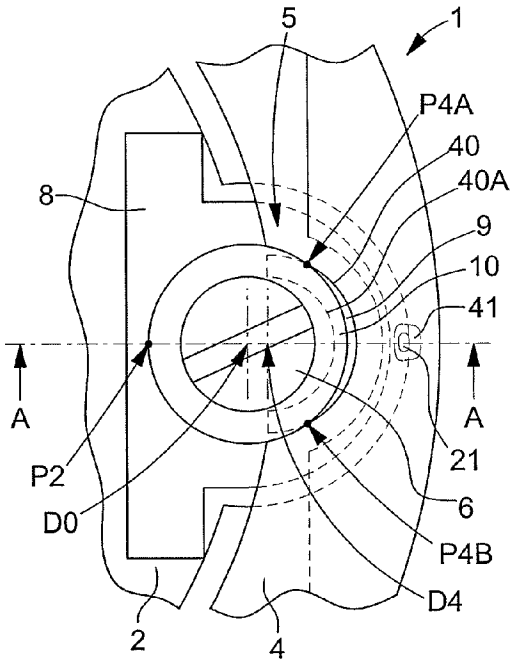
FIG. 6 shows a schematic, partial, top view of a variant of the invention wherein an identical flange to that of FIG. 1 rests on an inclined plane on the plate side, and on a conical plane on the middle part side.

In addition to FIGS. 1 to 5, which illustrate the preferred embodiment of the invention with conical shoulders 8 and 9 and a contact surface 19 in the form of a circular or toric edge in the case of FIG. 3, FIG. 6 shows a variant wherein a flange 10 with a contact surface 19 in the form of a circular edge rests on an inclined plane on the side of plate 2, and on a conical shoulder on the side of middle part 4. FIG. 8 shows a variant wherein flange 10 rests on a conical shoulder on the side of plate 2, and on an inclined plane on the side of middle part 4.

FIGS. 6 to 9 show a simple variant. However, maintaining the friction on the flange, on the side where it rests on an inclined plane, only occurs in friction if it is perfectly angularly centred. Otherwise the friction occurs on the side of the contact surface, which is less advantageous than the preferred variant of FIGS. 1 to 5.

FIG. 10 illustrates an assembly wherein plate 2 is held centred in middle part 4 by three sets of inclined planes, in each case one on plate 2 and one on middle part 4, on each of which a flange rests in gripping engagement with circular edge contact surface 19.

FIG. 4 illustrates a variant wherein plate 2 and middle part 4 comprise toric or spherical portion shaped shoulders 8 and 9.

FIG. 15 illustrates a variant wherein plate 2 includes a conic shoulder 8, and wherein middle part 4 includes a flat portion 9 receiving in abutment a bottom surface 19A of flange 10. This solution is only advantageous if flange 10 can abut, via a lateral surface 19C, with a bearing surface 4C of the middle part.

Figure 13:
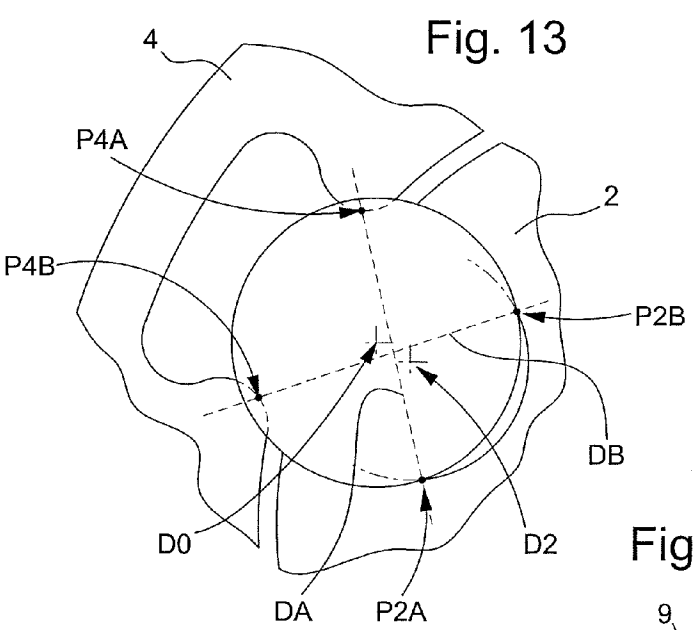
FIG. 13 is a diagram of the distribution of the contact points of the flange of FIG. 12.
Figure 12:
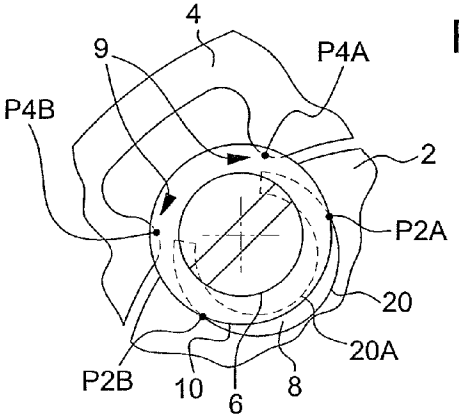
FIG. 12 shows a schematic, partial, top view of a variant of the invention wherein an identical flange to that of FIG. 1 rests on a conical shoulder on the plate side, and, on two shoulders forming edges on the middle part side.
Figure 14:
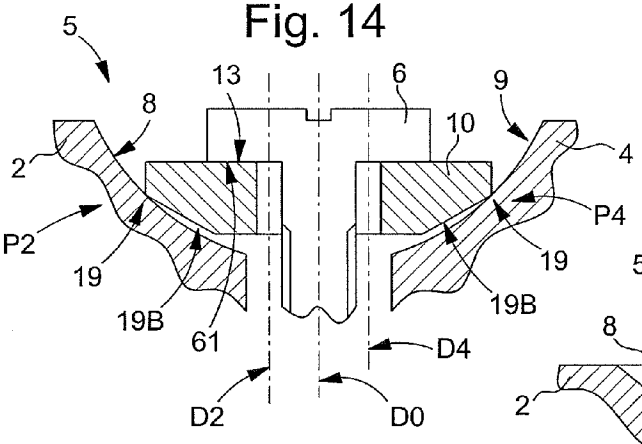
FIG. 14 shows, in a similar manner to FIG. 1, a variant wherein the plate and the middle part comprise shoulders which are toric or comprise a portion of a sphere.

FIG. 12 illustrates an advantageous variant of the invention wherein a flange 10 with a circular edge contact surface 19 rests on a conical shoulder 8 on the side of plate 2, and on two shoulders 9 forming edges on the side of middle part 4. FIG. 13 is a diagram of the distribution of contact points P2A, P2B, P4A, and P4B, of the flange 10 of FIG. 12, wherein the diagonals DA and DB of the quadrilateral formed by these four points intersect in proximity to axis D0 of housing 7.

A first way to envisage the invention is described here, with a flange 10 of simple shape, in particular circular, which cooperates with shoulders 8 and 9, which are skew surfaces or inclined planes or similar.

Figure 17:
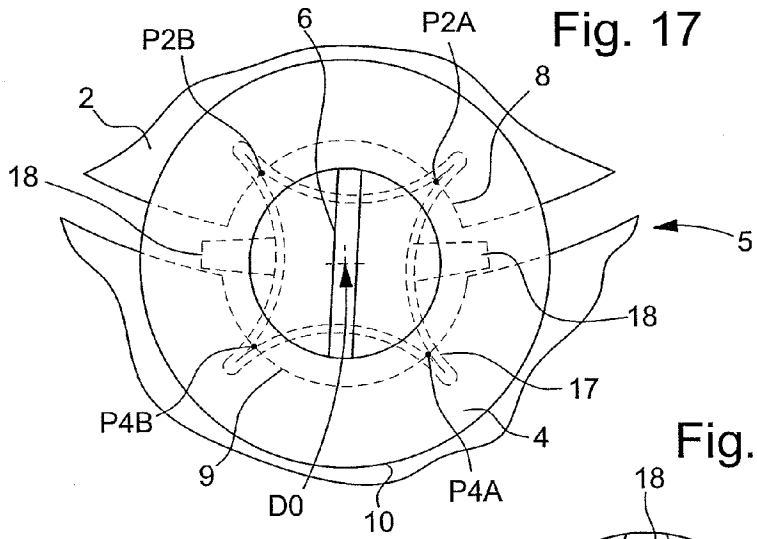
FIG. 17 shows a schematic, partial, top view of a variant of the invention wherein the plate and middle part each have a simple, straight-edged, cut out portion, the cut edges of which cooperate with a flange of particular shape comprising a bearing relief whose cut edges abut at specific points on the cut edges of said cut out portions.

A second way to envisage the invention, and which may also be combined with the preceding way, consists in making a flange 10 which includes abutment and contact edges with shoulders of the plate and the middle part which can then be reduced to their simplest embodiment: FIG. 17 illustrates a variant of the invention wherein plate 2 and middle part 4 each have a simple straight edged cut out portion, the edges 8, 9 of which cooperate with a flange 10 of particular shape including a bearing relief 17 whose edges abut particular points on edges 8, 9 of said cut out portions.

This flange 10 may be achieved in different ways, and in particular may be rigid or flexible. If the flange is rigid, the contact surfaces with the edges of plate 2 and middle part 4 which then form the shoulders are essentially isolated contact surfaces, whereas they may be curvilinear or superficial if flange 10 is made of flexible material.

Contact surface 19 of flange 10 is then formed by a projecting quadrangular, cruciform, or triangular star-shaped bearing relief 17. The contact between contact surface 19 of flange 10 and the first shoulder 8 occurs at one point P2 or two points P2A, P2B. The contact between bearing surface 19 of flange 10 and the second shoulder 9 occurs at one point P4 or two points P4A, P4B. Further, when the contact between flange 10 and first shoulder 8 and second shoulder 9 occurs at four points when screw 6 is completely screwed into housing 7, the diagonals DA; DB of the quadrilateral formed by the four points intersect in proximity to axis D0 of housing 7 and, when the contact between flange 10 and first shoulder 8 and second shoulder 9 occurs at three points when screw 6 is completely screwed into housing 7, the barycentre of the triangle formed by the three points is located in proximity to axis D0 of housing 7.

Figure 18A:
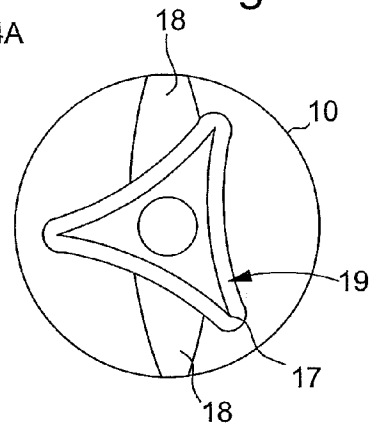
FIG. 18A shows a variant of said flange with a triangular relief profile.
Figure 18:
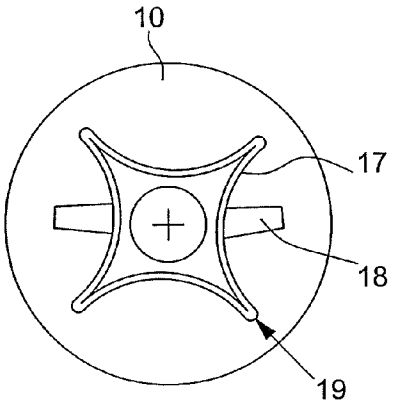
FIG. 18 shows a schematic, partial, bottom view of the bottom face of FIG. 17, comprising said bearing relief with cut edges and indexing fingers for orienting said cut edges relative to the gap between the plate and middle part.

FIG. 18 illustrates the bottom face of this flange 10 comprising bearing relief 17 with edges, which is quadrangular here, and indexing fingers 18 for orienting these edges relative to the space between plate 2 and middle part 4. FIG. 18A shows a variant of flange 10 with a triangular relief profile.

Figure 20:
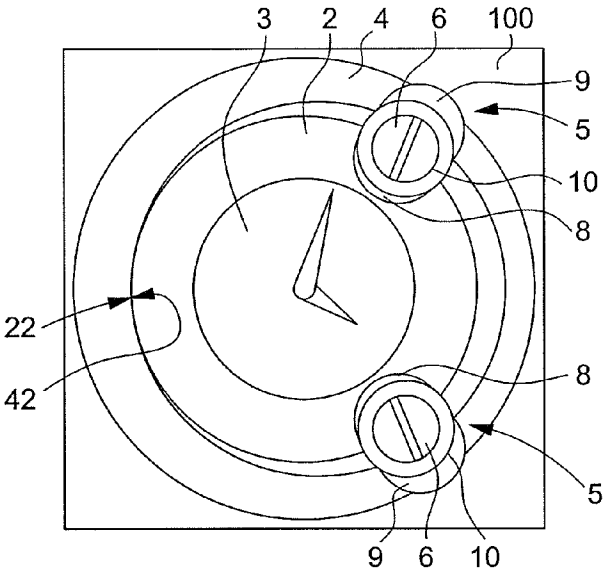
FIG. 20 shows, in the form of block diagrams, a timepiece comprising an assembly according to the invention, illustrated with a plate carrying a timepiece movement, and two flanges each cooperating with two conical shoulders.
Figures 23, 26A, 26B, 26C, 26D:
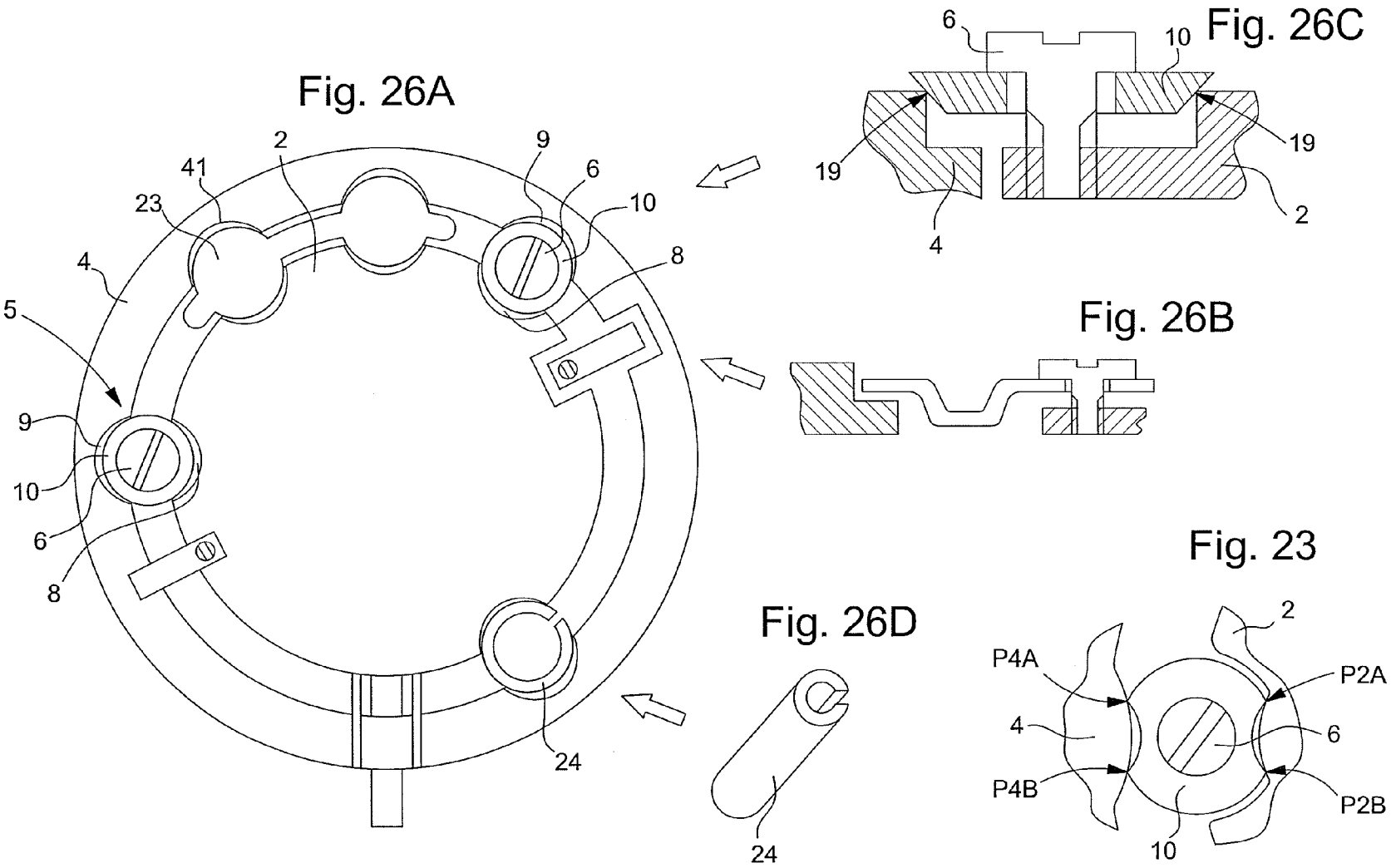

Other variants may be envisaged:

- a cam driven into the plate, as seen in FIG. 20, which shows a timepiece 100 including an assembly according to the invention, illustrated with a plate 2 carrying a timepiece movement 3 and two flanges 10 each cooperating with two conical shoulders 8, 9;
- FIG. 21 shows a middle part 4 with a recess 40 of semi-circular section. Plate 2 includes a flexible peripheral rib 25 bordered on the inner side of the plate with a recess 26. Flange 10 forms a cam, which, when flange 10 is tightened in its housing 7, abuts, via an end 15 thereof, on an inner surface 27 of flexible rib 25, so as to lock two contact surfaces P4A, P4B inside recess 40.
- FIGS. 22A, 22B, 22C show a circular slit flange 10 with an inner cone. It cooperates with two semi-cylindrical housings 20 and 40. In FIG. 22B according to a preferred embodiment, the axes of the cylinders do not coincide with the axis of screw 6. There are 4 contact areas here P4A, P4B, P2A and P2B;

FIG. 23 shows the application of the same principle to bearing surfaces which are convex instead of concave. It is then flange 10 which has 4 contact areas P4A, P4B, P2A and P2B in a preferred embodiment.

the combination of a flexible flange 10 as seen in FIG. 24, with 4 arms 17 and a countersunk screw, which, when screwed in, has the effect of moving apart the 4 contact point. The screwing-in operation has the effect of deforming the periphery of flange 10 and gripping the periphery. This arrangement allows locking in a cylindrical aperture;

In FIG. 25, an oval instead of a cam, with an inner conical gradient, advantageously combined with a vertical slot in the plate, allowing any rotational stress to be converted into gripping force;

the notion of a slit washer (FIGS. 22A, 22B, 22C, 25) can be applied in both directions, with a shoulder or a top female cone (FIG. 29) or bottom male cone (FIG. 30) so that, as a result of the screwing-in stress, the washer is closed instead of opened;

a snail driven into the plate, even better than a simple cam, since it allows two points of abutment to be maintained without any angular deformation;

a semi-cone male protruding portion 21 on a plate projecting upwards, a similar or identical protruding portion 22 on the middle part, combined with a flange covering both and comprising a bearing surface reduced to a circular edge, or in the form of a female cone (FIGS. 27 and 28). FIG. 26 illustrates an example combination between the over-abundant types of positioning and securing mechanisms described above, possibly combined with flanges, an indexing rod cooperating with one or several angular indexing housings 41, a split ring 24.

The difficulty in choosing between the numerous possible solutions consists in ensuring, with the minimum number of components, an isostatic, easy to assemble connection, which is resistant to the stresses and accelerations to which a timepiece is subjected during use. The embodiments according to FIGS. 1 to 5 constitute a preferred embodiment of the invention, since they efficiently satisfy these criteria, and are compact. They may be placed, at lower cost, in existing calibres, and only require conical or spherical machining in the plate and middle part, which does not raise any manufacturing problems.

In a preferred application, plate 2 forms a support for at least one timepiece movement 3, and middle part 4 is arranged to at least partially contain movement 3.

The use, on the middle part and plate, of shoulders of conical bowl or spherical shape revolving about an axis in proximity to the screw axis or merged therewith, thus provides advantages of centring quality combined with the advantages of durable gripping quality.

Preferably, even if it is possible to imagine using a flexible or even resilient flange, such as a strip spring, the preferred embodiment of the invention implements a rigid flange, at least in a particular and preferred embodiment of the invention.

In a particular embodiment of the invention, if space is lacking, it is possible to combine the abutment of the flange, on a first side on a conical or spherical shoulder of the plate or the middle part, and, on the opposite side respectively of the middle part or the plate, with corner scaffolding in a shoulder of said middle part or said plate.

Preferably, according to the invention and as seen in the Figures, the abutments occur on the same side of the flange relative to the screw head. Thus, the flange always works in compression abutment on the shoulders of the middle part and the plate, which ensures perfect durable clamping.

The invention further concerns a timepiece 100 or piece of jewellery including at least one said timepiece assembly 1 or a timepiece assembly 1 wherein plate 2 constitutes a support for at least one jewellery component, and wherein middle part 4 is arranged to at least partially contain said component.

In a particular application, said timepiece 100 has a single push-button. More particularly, said timepiece 100 is a chronograph with a single push-button, for which the invention provides advantages of stability during frequent axial manoeuvres in the direction of the push-button, while ensuring maximum security against shocks and accelerations.

It is thus seen that the principle of the invention is applicable to numerous geometries. Some are more interesting than others, and the invention provides the best advantages in the embodiment of FIGS. 1, 2, 3, 4, 5, 12, 13, 14 and 17 with, in particular, a flange 10 comprising a bearing surface 19 arranged to cooperate with a first conical or spherical or similar shoulder 8 of plate 2, and with a second, conical or spherical or similar shoulder 9 of middle part 4, bearing surface 19 being a surface of revolution about a flange axis D10 perpendicular to the top bearing surface 13 of the flange and arranged to coincide with axis D0 of housing 7, in the assembled position and in the position where screw 6 is completely screwed into housing 7. Indeed, this arrangement prevents any perturbation torque due to forces with an oblique component, unlike ordinary types of securing devices. In current devices for securing movements to cases, there is never a strictly perpendicular flange, and any perturbation torque linked to the thread decreases the application force, and the effect of repeated shocks and the application of accelerations inevitably leads to plays and to the movement moving inside its case.

The arrangement according to the invention provides a balance of the moments of force applied to the flange, via the screw, with very short lever arms (corresponding here to the distance between axis D0 and the contact surfaces), which means that, for an equal torque, a very high force can be applied at each contact surface or point, again compared to an ordinary securing device where the lever arm is formed by the distance between the centre of the movement and the contact surface, and where, with an equal moment of screw torque, the force applied to each contact surface is much lower.

The invention therefore provides a securing device which has no play, and is very stable over time since it is not sensitive to the effects or accelerations and particularly shocks.

In short, the invention provides system for locking via shape with no play to prevent a movement becoming detached from its case in the event of shocks. The choice of a circular conical flange means that the movement and the middle part can be precisely angularly positioned, and a defined interface can be observed between the case and the movement.

What is claimed is:

1. A timepiece assembly including a bottom plate, a middle part arranged to cooperate in abutment with said bottom plate, and a means of securing said bottom plate to said middle part, said securing means including at least one screw, each screw of the at least one screw arranged to cooperate in the screwed-in position with a respective axis housing disposed in said bottom plate, to indirectly immobilize said middle part relative to said bottom plate via a flange specific to said screw, each said flange being arranged to transmit the tightening force of said screw by abutting both on a first, conical or spherical shoulder comprised in said bottom plate in proximity to each said housing, and on a second, conical or spherical shoulder comprised in said middle part in proximity to each said housing, said assembly being wherein, in an assembled position wherein said bottom plate and said middle part are assembled to each other and the position wherein said screw is completely screwed into said housing, said first shoulder and/or said second shoulder cooperates with said flange on at most two surfaces or points.

2. The timepiece assembly according to claim 1, wherein said flange is independent of said screw and includes a top bearing surface arranged to cooperate, in said assembled position and in the position wherein said screw is completely screwed into said housing, with a bottom bearing surface comprised in said screw, on a contact surface of revolution relative to said axis of said housing.

3. The timepiece assembly according to claim 2, wherein any normal line, at a point on said first shoulder of said bottom plate, to the tangent plane at this point to said shoulder, passes through an axis parallel to and at a distance from said axis of said housing, at a point which is located outside said housing on the side of said housing through which said screw is inserted into said housing.

4. The timepiece assembly according to claim 3, wherein said first shoulder of said bottom plate is a surface of revolution about said axis.

5. The timepiece assembly according to claim 4, wherein said middle part includes a means of angularly indexing position in an angular direction relative to a complementary angular indexing means of said bottom plate to which said middle part is coaxial in said assembled position, so as to define an angularly indexed position of said bottom plate relative to said middle part, such that in said indexed position, any normal, at a point on said second shoulder of said middle part, to the tangent plane at that point to said shoulder, passes through said axis, at a point which is located, in said assembled position of said bottom plate and said middle part, outside said housing on the side of said housing through which said screw is inserted into said housing.

6. The timepiece assembly according to claim 2, wherein said second shoulder of said middle part is a surface of revolution about an axis which is parallel to said axis of said housing in said assembled position, and wherein any normal line, at one point on said second shoulder of said middle part, to the tangent plane at that point to said shoulder passes through said axis, at a point which is located, in said assembled position of said bottom plate and said middle part, outside said housing on the side of said housing through which said screw is inserted into said housing.

7. The timepiece assembly according to claim 6, wherein, in said assembled position and in the position where said screw is completely screwed into said housing, said axis of said second shoulder of said middle part is at a distance from said axis of said first shoulder of said bottom plate, and said axis and said axis are parallel on either side of said axis of said housing.

8. The timepiece assembly according to claim 7, wherein said first shoulder of said bottom plate is conical at a taper angle relative to a perpendicular plane to said axis, wherein said second shoulder of said middle part is conical at a taper angle relative to a perpendicular plane to said axis identical to said taper angle, and wherein, in a perpendicular plane to said axis of said housing for said screw corresponding to the abutment of said flange on said first shoulder and said second shoulder, in the assembled position wherein said screw is completely screwed into said housing, the radius of the section of said first shoulder and the radius of the section of said second shoulder have values comprised between 0.91 and 0.97 times the value of the radius of the shoulder of said flange, on the bearing surface thereof, with said first shoulder and said second shoulder, and wherein the eccentricity between said axis and said axis on the one hand, and between said axis and said axis on the other hand, has values comprised between 0.03 and 0.05 times said value of the radius of the shoulder of said flange.

9. The timepiece assembly according to claim 6, wherein said middle part includes a means of angularly indexing position in an angular direction relative to a complementary angular indexing means of said bottom plate to which said middle part is coaxial in said assembled position, so as to define an angularly indexed position of said bottom plate relative to said middle part, such that in said indexed position, any normal line, at a point on said first shoulder of said plate, to the tangent plane at that point to said shoulder, passes through said axis, at a point which is located, in said assembled position of said bottom plate and said middle part, outside said housing on the side of said housing through which said screw is inserted into said housing.

10. The timepiece assembly according to claim 2, wherein said flange has a bearing surface arranged to cooperate with said first shoulder of said bottom plate, and with a second shoulder of said middle part, said bearing surface being a surface of revolution about a flange axis perpendicular to said top bearing surface and arranged to coincide with said axis of said housing, in said assembled position and said position where said screw is completely screwed into said housing.

11. The timepiece assembly according to claim 10, wherein said bearing surface is reduced to a circular edge of revolution about said flange axis.

12. The timepiece assembly according to claim 11, wherein, connected to said bearing surface and on the opposite side to said top bearing surface, said flange includes a tapered surface arranged to allow said flange axis of said flange limited angular mobility relative to said axis of said housing for said screw, in the assembled position and while said screw is being screwed into said housing.

13. The timepiece assembly according to claim 12, wherein said tapered surface is conical at an angle of taper of the flange relative to a plane perpendicular to said flange axis, wherein said first shoulder of said bottom plate is conical at a conical angle relative to a plane to said axis, wherein said second shoulder of said middle part is conical at a conical angle relative to a plane perpendicular to said axis and said flange taper angle is smaller, by a value of less than 2°, than said taper angle and said taper angle.

14. The timepiece assembly according to claim 13, wherein said flange taper angle has a value of 52°, and wherein said conical angle and said conical angle each have a value of 53°.

15. The timepiece assembly according to claim 11, wherein the contact between said contact surface of said flange and said first shoulder, occurs at two points separated by a central angle relative to said axis of said housing, wherein the contact between said bearing surface of said flange and said second shoulder occurs at two points separated by a central angle relative to said axis of said housing, and wherein the value of each of said central angles is comprised between 53° and 118°.

16. The timepiece assembly according to claim 11, wherein said contact surface of said flange is formed by a cruciform or triangular star-shaped projecting bearing relief), and the contact between said contact surface of said flange and said first shoulder occurs at one point or two points, wherein the contact between said bearing surface of said flange and said second shoulder occurs at one point or two points and wherein, when the contact between said flange and said first shoulder and said second shoulder occurs at four points when said screw is in the completely screwed-in position in said housing, the diagonals of the quadrilateral formed by said four points intersect in proximity to said axis of said housing, and wherein, when the contact between said flange and said first shoulder and said second shoulder occurs at three points when said screw is in the completely screwed-in position in said housing, the barycentre of the triangle formed by said three points is located in proximity to said axis of said housing.

17. The timepiece assembly according to claim 1, wherein said middle part includes stop means arranged to cooperate with complementary stop means comprised in said bottom plate to limit the space between said middle part and said bottom plate, in said assembled position and the position wherein said screw is completely screwed into said housing.

18. The timepiece assembly according to claim 1, wherein said bottom plate forms a support for at least one timepiece movement and wherein said middle part is arranged to at least partially contain said movement.

19. The timepiece assembly according to claim 1, wherein, in said assembled position wherein said bottom plate and said middle part are assembled to each other and in the position where said screw is completely screwed into said housing, said bottom plate and said middle part each cooperate with said flange at at least two points.

20. The timepiece assembly according to claim 1, wherein said first shoulder is a surface of revolution about an axis which is parallel to said housing and separated therefrom by a distance of 0.10 to 0.20 mm.

21. The timepiece assembly according to claim 1, wherein said second shoulder is a surface of revolution about an axis which is parallel to said axis of said housing and separated therefrom by a distance of 0.10 to 0.20 mm in said assembled position.

22. The timepiece according to claim 1, wherein includes a single push-button.

23. A piece of jewelry including at least one timepiece assembly according to claim 1, wherein said bottom plate forms a support for at least one jewelry component, and wherein said middle part is arranged to at least partially contain said component.

* * * * *